US006016613A

United States Patent [19]

Campbell et al.

[11] Patent Number: 6,016,613

[45] Date of Patent: Jan. 25, 2000

[54] GOLF SHOE OUTSOLE WITH PIVOT CONTROL TRACTION ELEMENTS

[75] Inventors: Derek Campbell, Portland; Peter Phillip Backus, Newberg, both of Oreg.

[73] Assignee: Nike International Ltd., Beaverton, Oreg.

[21] Appl. No.: 08/964,554

[22] Filed: Nov. 5, 1997

[51] Int. Cl.[7] ..... A43B 23/28; A43B 5/00

[52] U.S. Cl. ..... 36/59 C; 36/127; D2/906

[58] Field of Search ..... 36/59 R, 59 C, 36/122, 123, 124, 125, 126, 127, 128, 129, 32 R, 114; D2/954, 955, 956, 947, 906

[56] References Cited

U.S. PATENT DOCUMENTS

| | | | |
|---|---|---|---|
| D. 90,450 | 8/1933 | Oakley . | |
| D. 201,952 | 8/1965 | Johns . | |
| D. 259,595 | 6/1981 | Famolare, Jr. | D2/320 |
| D. 272,580 | 2/1984 | Stubblefield | D2/320 |
| D. 294,655 | 3/1988 | Heyes | D2/320 |
| D. 304,778 | 11/1989 | Le et al. | D2/320 |
| D. 320,108 | 9/1991 | Hatfield et al. | D2/320 |
| D. 323,738 | 2/1992 | Eisenbach | D2/317 |
| D. 324,763 | 3/1992 | Kayano | D2/264 |
| D. 324,764 | 3/1992 | Allen | D2/320 |
| D. 327,975 | 7/1992 | Saito et al. | D2/314 |
| D. 331,487 | 12/1992 | Arai | D2/320 |
| D. 331,491 | 12/1992 | Ohno | D2/320 |
| D. 334,834 | 4/1993 | McDonald | D2/320 |
| D. 339,452 | 9/1993 | Hoshimi | D2/317 |
| D. 339,459 | 3/1993 | Hoshimi | D2/317 |
| D. 345,453 | 3/1994 | Carpenter | D2/955 |
| D. 351,716 | 10/1994 | Kawasaki | D2/952 |
| D. 352,386 | 11/1994 | Vestuti et al. | D2/953 |
| D. 354,845 | 1/1995 | Bramani | D2/957 |
| D. 355,754 | 2/1995 | Brandon | D2/951 |
| D. 356,672 | 3/1995 | Ueda | D2/959 |
| D. 362,956 | 10/1995 | Martin et al. | D2/961 |
| D. 371,893 | 7/1996 | Kayano et al. | D2/959 |
| D. 373,897 | 9/1996 | Takatani et al. | D2/957 |
| D. 373,898 | 9/1996 | Bramani | D2/953 |
| D. 374,337 | 10/1996 | Murai et al. | D2/956 |
| D. 391,044 | 2/1998 | Backus | D2/954 |
| D. 392,448 | 3/1998 | Backus | D2/954 |
| D. 396,549 | 8/1998 | von Conta et al. | D2/955 |
| 1,087,212 | 2/1914 | Caldwell . | |
| 4,096,649 | 6/1978 | Saurwein | 36/32 R |
| 4,266,349 | 5/1981 | Schmohl | 36/32 R |
| 4,347,674 | 9/1982 | George | 36/126 |
| 4,586,274 | 5/1986 | Blair | 36/59 R |
| 4,897,936 | 2/1990 | Fuerst | 36/30 A |
| 4,914,838 | 4/1990 | Ihlenburg | 36/114 |
| 5,201,126 | 4/1993 | Tanel | 36/134 |
| 5,203,097 | 4/1993 | Blair | 36/59 |
| 5,293,701 | 3/1994 | Sullivan | 36/59 R |
| 5,367,793 | 11/1994 | Deacon et al. | 36/134 X |
| 5,628,129 | 5/1997 | Kilgore et al. | 36/134 |
| 5,761,832 | 6/1998 | George | 36/59 C |

*Primary Examiner*—B. Dayoan
*Attorney, Agent, or Firm*—Banner & Witcoff, Ltd.

[57] ABSTRACT

There is disclosed a golf shoe having a plurality of first and second traction projections extending out from the outsole to define a ground engaging surface. The first traction projections are arranged around a first pivot point located in the forefoot portion and a second pivot point located in the rearfoot portion of the outsole. The first traction projections have a body orientated lengthwise toward the pivot points. The second traction projections extend out from the outsole along the periphery of the outsole. The first and second traction projections define a ground engaging surface which, in use, enhance the traction of the outsole during the full golf swing motion.

5 Claims, 4 Drawing Sheets

GOLF SHOE OUTSOLE WITH PIVOT CONTROL TRACTION ELEMENTS

BACKGROUND OF THE INVENTION

1. Field of Invention

The present invention relates in general to athletic shoes. More specifically, but without restriction to the particular use which is shown and described, this invention relates to golf shoe outsoles having pivot control traction elements that enhance the traction of the golf shoe during the golf swing motion.

2. Description of the Related Art

Depending on the sport, a variety of traction members, cleats, or spikes are used in different orientations in order to improve the traction of the athletic shoe. For example, metal or plastic cleats are often used for baseball, football or soccer footwear with the cleats formed integral or, alternatively, detachable with the outsole of the shoe. In golf, traditional golf shoes typically comprise an outsole having a plurality of replaceable spikes or cleats secured to the outsole. These spikes extend downwardly from the outsole to improve the traction of the shoe.

Current styles of golf cleats or spikes include metal spikes and green-friendly plastic spikes. Unlike the metal spikes which are a single downwardly extending, rotatably fastened projection, the green-friendly plastic spikes consist of multiple knobs or rounded protuberances, rotatably fastened to the outsole. These green-friendly spikes, do not break through the surface of the putting greens on the golf course, thereby resulting in less damage to the golf greens. In addition, the green-friendly spikes provide traction during the golf swing motion comparable to the customary metal spikes.

When using replaceable spikes, the service life of the shoe is extended because a damaged or worn spike can merely be replaced rather than having to discard the entire shoe. Replaceable spikes generally have a threaded screw attachment element and a similar threaded receptacle is provided in the sole of the golf shoe. Conventionally, the replaceable spikes are secured to the outsole in a spaced apart relationship at the forefoot and rearfoot. With typical golf shoe spike arrangements, seven spikes are located near the periphery of the ball area of the outsole and four spikes are located near the periphery of the heel area of the outsole. Golf shoes with integrally formed green-friendly spikes, that is, non-replaceable traction elements, are also currently available.

It is known that pressure points occur on the feet during the golf swing motion. The location and level of pressure of the pressure points can be seen in Golf Digest, February 1992, pages 64–65, and is incorporated herein by reference ("Golf Digest"). During a golf swing, weight distribution shifts from an even distribution at address to primarily on the back (driving) foot at the top of the backswing to the forward (stabilizing) foot after impact. As a result of this weight distribution, the most critical time to enhance traction is from the beginning of the downswing through impact. At the beginning of the downswing, weight is concentrated on the driving foot at a forefoot pivot location on the medial side of the foot, adjacent the first metatarsal head. Through impact, weight becomes concentrated on the stabilizing foot at a rearfoot pivot location on the lateral side of the shoe, adjacent the heel. See Golf Digest. During this swing motion time period, a limited amount of pivot can occur at the forefoot and rearfoot pivot locations. However, this pivoting must be limited or controlled in a manner such that the foot does not slip out of position and foot traction is maintained.

Current golf shoe designs do not have spikes or cleats located at or around the pivot points where weight concentration and resulting foot pressure is at a maximum. As stated above, traditional golf shoes have spikes located along the periphery of the golf shoe and not at the forefoot and rearfoot pivot locations where traction is crucial. Thus, optimum foot traction during the golf swing motion is not obtained with current golf shoe outsoles.

SUMMARY OF THE INVENTION

The invention relates to a sole for an athletic shoe, preferably a golf shoe. The sole includes an outsole defining a forefoot portion, a rearfoot portion, and a periphery. A plurality of first traction projections extend out from the outsole to define a ground engaging surface. A forefoot group of the first traction projections are arranged around a first pivot point located in the forefoot portion and a rearfoot group of the first traction projections are arranged around a second pivot point located in the rearfoot portion of the outsole. The plurality of first traction projections have a lengthwise portion orientated in the general direction of the pivot points. The plurality of first traction projections thus enhance the traction of the outsole during pivoting of the athletic shoe.

The plurality of first traction projections may be arranged elliptically or in any radial pattern around the first and second pivot points. The sole may also include a plurality of threaded openings for securing detachable cleats. Accordingly, the traction or stability of the golf shoe during typical golf club swing motion is enhanced, and the pivoting of the foot is controlled so as to prevent the foot from slipping during the full swing motion.

Briefly stated, in summary, the present invention involves orientating the lengthwise extent of a plurality of first traction projections, such as rubber cleats formed integral with the base of the outsole, in the general direction of the pivot points that occur in the heel and forefoot of the feet during the golf club swing motion. These rubber cleats enhance the traction or stability of the golf shoe during the full golf swing motion, particularly when combined with traditional metal spikes or the new green-friendly plastic spikes.

As stated above, the location of the pivot points are the points where the foot is under the highest distribution of weight during the golf swing. It is at these locations where traction of the golf shoe is critical. The forefoot pivot point is found during the downswing by the driving foot and the rearfoot pivot is found in the stabilizing foot near impact. Consequently, with each shoe, two elliptical cleat patterns are located in the forefoot and one pattern in the rearfoot. The elliptical cleat patterns comprise a plurality of rubber cleats which are generally oval shaped and arranged in an elliptical pattern around the pivot locations with the lengthwise portion of the cleat angled in the direction of the center of the pivot location. The orientation of the cleats toward the center of the pivot location inhibit pivoting. Moreover, rubber cleats are located around the perimeter of the outsole for added traction. Thus, the present invention combines traditional metal or plastic spikes with molded rubber cleats orientated around the pivot points and the perimeter of the outsole to create enhanced traction across the entire outsole of the golf shoe.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWINGS

The preferred embodiment of the invention will be described in relation to the accompanying drawings. In the drawings, the following figures have the following general nature.

DESCRIPTION OF THE PREFERRED EMBODIMENTS

Figure 1:
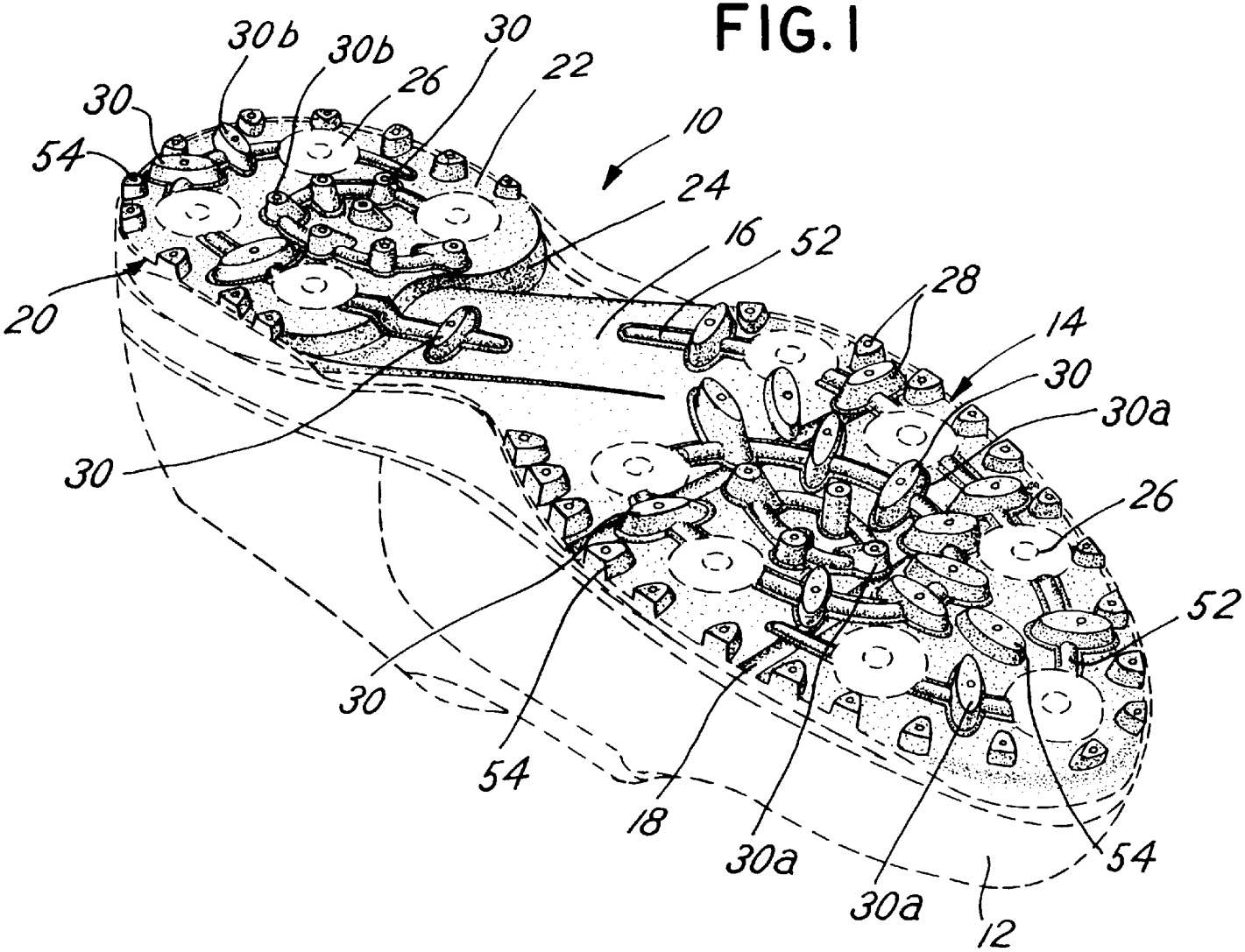
FIG. 1 is a bottom elevation view of a golf shoe in accordance with the present invention.

Referring to the drawings wherein like numerals indicate like elements, there is shown in FIG. 1 a golf shoe 10 in accordance with the present invention. Golf shoe 10 includes an upper 12 attached to an outsole 14 in a conventional manner such as with an adhesive. Upper 12 can be made of conventional material and be of a conventional design typical of golf shoe uppers.

Figure 2:
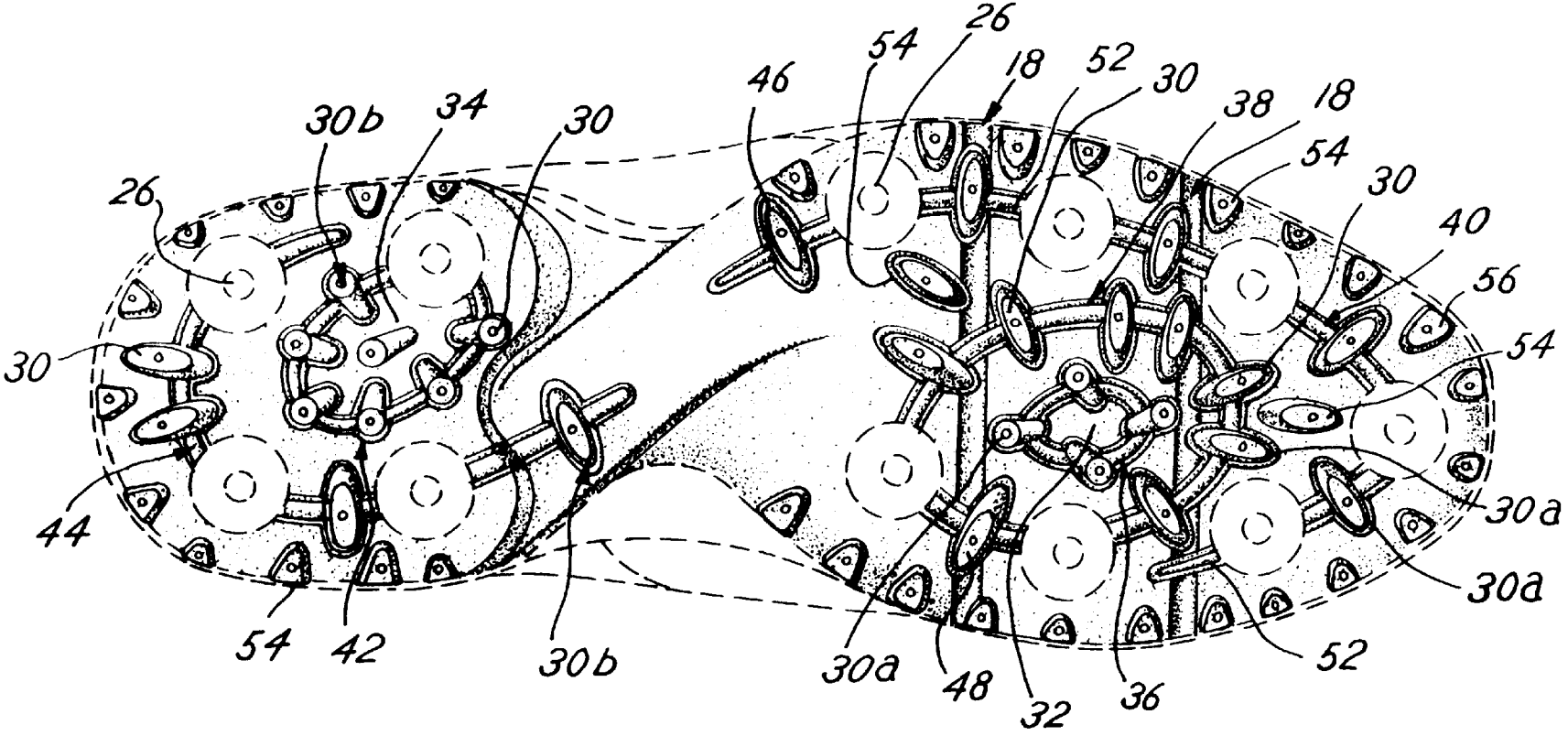
FIG. 2 is a plan view of the bottom of the golf shoe of FIG. 1.

Referring to FIGS. 1 and 2, outsole 14 includes an outsole plate or base 16, which extends along the entire length of the outsole. The outsole plate 16 defines a generally planar surface and may be made of rubber or other moldable material. Longitudinally spaced and laterally extending grooves 18 extend across the outsole plate 16 in the forefoot area. In use, the grooves 18 allow longitudinal flexing of the outsole plate 16. In the heel area of the foot, the outsole plate 16 includes a heel projection 20 extending out from the plane of the plate 16 and terminating into a heel surface 22 that is in parallel relation to the plate 16. The heel projection 20 is preferably formed out of the outsole plate 16 with a gradual transition portion 24 inclining from the plate 16 to the heel projection 20.

In the ball area and the heel area of the foot, located near the periphery of the outsole 14, are a plurality of threaded holes or openings 26 for receiving detachable metal or plastic spikes. Traditionally with golf shoe designs, eleven threaded openings 26 are located on the outsole 14. Four openings 26 are located in the heel projection 20 and are positioned in a relatively square pattern along the periphery of the heel. In the ball area of the outsole 14, seven openings 26 are positioned near the periphery of the outsole 14 in a relatively elliptical pattern. As conventional, detachable spikes are threaded into the openings 26 to provide ground engaging traction during the golf swing.

In a preferred embodiment, outsole 14 further includes pivot control traction elements 28 extending out from the outsole plate 16 and the heel surface 22. Pivot control traction elements 28 comprise a plurality of first traction projections 30 extending out from the outsole plate 16 and the heel surface 22 to define a ground engaging surface. The plurality of first traction projections 30 include a forefoot group of traction projections 30*a* that are arranged in a preferred elliptical pattern around a pivot point 32 located in the forefoot or ball area of the foot, and a rearfoot group of traction projections 30*b* that are arranged in a preferred elliptical pattern around a pivot point 34 located in the rearfoot or heal area of the foot. It should be noted that any radial pattern of traction projections 30 may be arranged around the pivot points 32 and 34.

As exemplified by FIG. 2, more than one elliptical pattern of first traction projections 30 may be concentrically positioned around the pivot points 32 and 34. FIG. 2 illustrates two concentric elliptical patterns and one half-elliptical pattern of traction projections 30 in the forefoot group of traction projections 30*a* around the pivot point 32 of the forefoot. An inner ellipse pattern 36 is located closest to the pivot point 32 with traction projections 30 positioned around the inner ellipse 36. A middle ellipse pattern 38 is concentrically spaced out from the inner ellipse 36 with slightly larger traction projections 30 positioned around the middle ellipse 38. An outer half-ellipse pattern 40 is concentrically spaced out from the middle ellipse 38 and is located near the periphery of the outsole plate 16 of the forefoot. As with the middle ellipse pattern 38, slightly larger traction projections 30 are positioned around the outer half-ellipse 40.

The rearfoot group of traction projections 30*b* are arranged in an elliptical pattern and a half-elliptical pattern around the pivot point 34 of the rearfoot. An inner ellipse pattern 42 is positioned closest to the pivot point 34 with traction projections 30 located around the inner ellipse 42. Similar to the half-ellipse pattern 40 around the pivot point 32 of the forefoot, an outer half-ellipse pattern 44 is concentrically spaced out from the inner ellipse 42 with traction projections 30 located along the outer half-ellipse 44. Depending on the desired level of traction, variations in the number of patterns around the pivot points is contemplated and within the scope of the invention.

Figure 4:
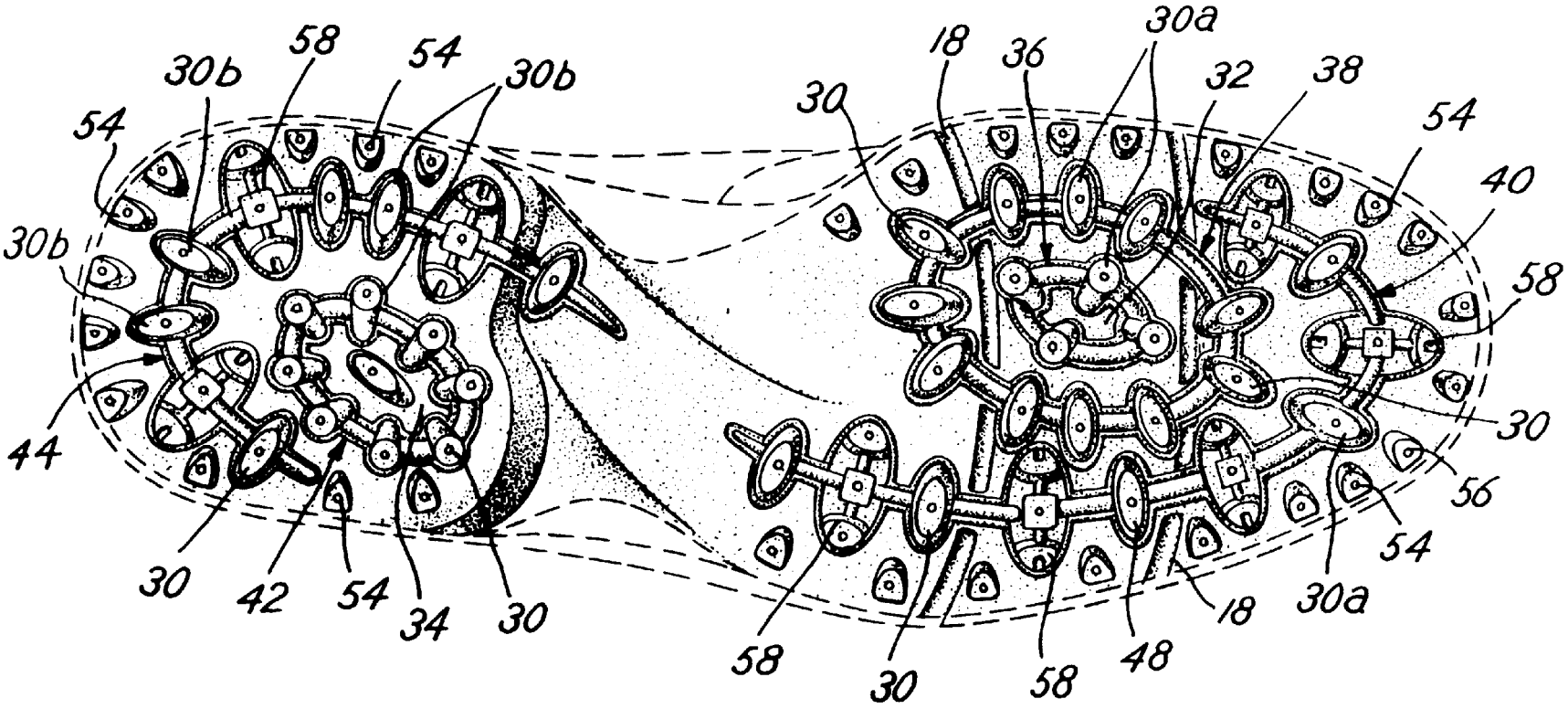
FIG. 4 is a plan view of the bottom of the golf shoe of FIG. 3.

The plurality of first traction projections 30 are distributed uniformly at a relatively close spacing along the elliptical patterns. In the illustrated embodiment, traction projections 30 are formed as cleats of rubber or other high friction material that is formed integral with the outsole base or plate 16. The projections 30 define a projection body 46 having a generally oval configuration in plan view and, as depicted in FIGS. 2 and 4, the projection body 46 has a lengthwise portion. As illustrated and preferred, the lengthwise portion of the projection body 46 is orientated in the general direction of the pivot points 32 and 34. This orientation of the traction projections 30 in the general direction of the pivot points places the lengthwise of the projection body 46 approximately perpendicular to a circle about the pivot points and thus enhance the traction of the outsole 14 and the golf shoe 10 during the full golf swing motion.

The projection body 46 extends perpendicular from the plane formed by the outsole plate 16 and is molded integral with the surface of the outsole plate 16 and the heel surface 22. Note that the present invention is not limited by the manner in which the traction projections are secured to the outsole 14. The projection body 46 terminates to form a projection body traction surface 48 which is generally oval in configuration and is parallel with the plane formed by the outsole plate 16. Projection body 46 further defines a side wall 50 which extends from the outsole plate 16 or heel surface 22 to the traction surface 48 and circumscribes the oval configuration of the traction surface 48. For strength and durability purposes, the side wall 50 is slightly convex, tapering from the base of the projection body 46 to the traction surface 48. While relatively stiff, the projection body 46 may bend or flex slightly depending on the type and quality of rubber material used which further depends on the desired wear capabilities. It should be noted that traction projection 30 can be formed in any shape which has a side wall orientated generally toward the pivot points 32 and 34. In addition, each projection body 46 is connected near its lengthwise midpoint by a rib 52, as exemplified in FIGS. 2 and 4. The rib 52 provides support strength to the projection body 46 and prevents shearing of the traction projections 30 when a golfer exerts a shearing force on the golf shoe 10 during the golf swing motion.

As exemplified by FIG. 2, the elliptical pattern of first traction projections 30 may be positioned on the outsole 14 so that a detachable spike replaces one or more traction projection 30. In other words, an elliptical pattern may comprise a combination of traction projections 30 and detachable spikes.

Moreover, the plurality of action elements 28 further comprise a plurality of second traction projections 54 extending out from the outsole 14. These second traction projections 54 are cleats made of rubber or other high friction material that are formed integral with the outsole base or plate 16, and are located along the periphery of the forefoot and rearfoot of the outsole 14. As with the first traction projections 30, the second traction projections 54 define a projection body 56 although having, in plan view, a triangular configuration. Unlike the first traction projections 30, there are no ribs connecting the second traction projections 54. In addition to the second traction projections 54 located along the periphery of the outsole 14, second traction projections 54 are also located near the tip and the lateral side of the forefoot between the middle ellipse 38 and the outer half-ellipse 40. These projections 54 have a generally oval configuration in plan view. Second traction projections 54 are also located in the rearfoot at the pivot point 34 and near the center of the rearfoot between the inner ellipse 42 and the outer half-ellipse 44. These traction projections 54 in the rearfoot have a teardrop configuration in plan view. The second traction projections 54 provide added traction near the perimeter of the outsole 14 of the golf shoe 10.

Figure 3:
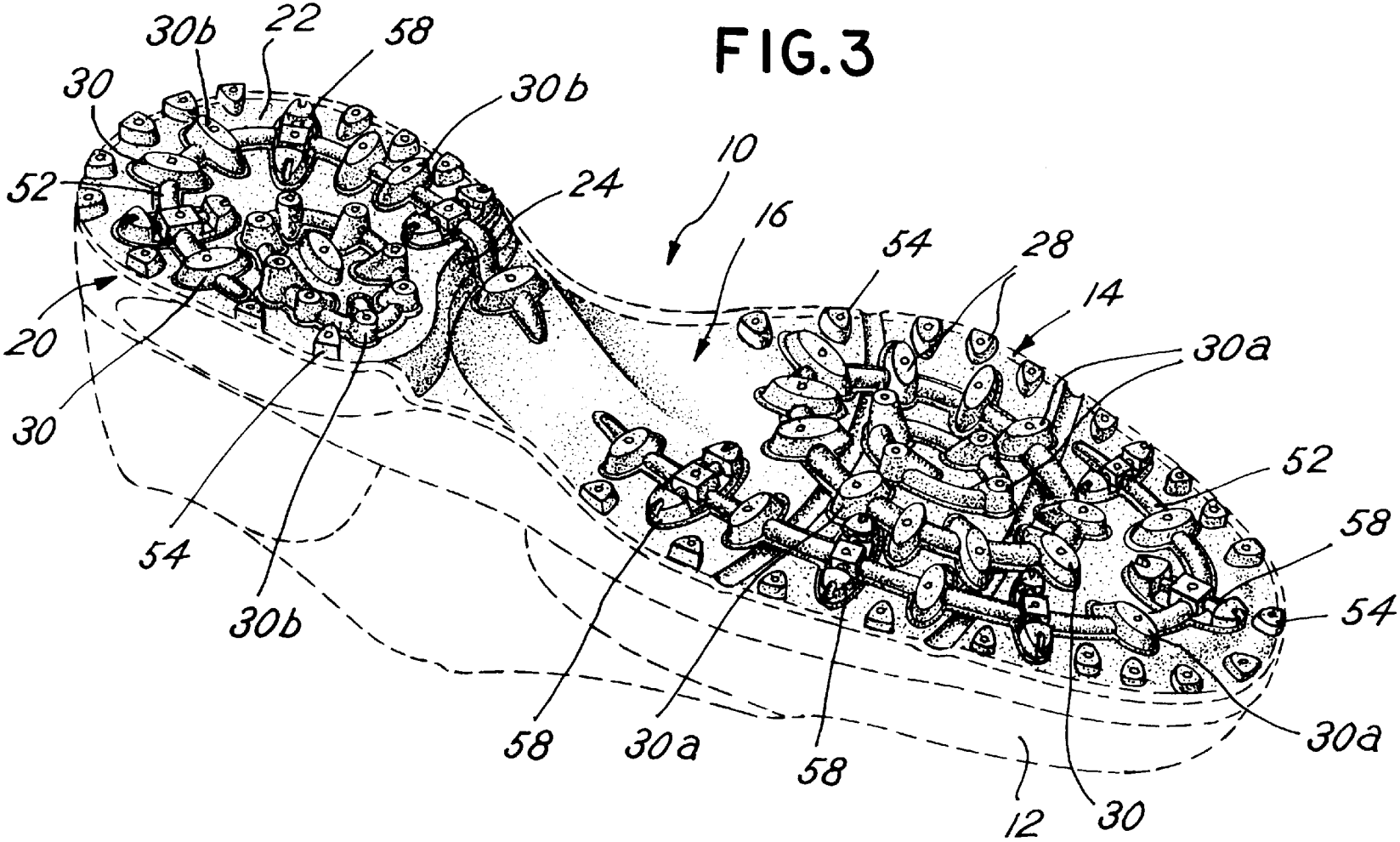
FIG. 3 is a bottom elevation view of another embodiment of a golf shoe in accordance with the present invention.

As exemplified in FIGS. 3 and 4, an alternative embodiment of the invention comprises the plurality of first and second traction projections 30 and 54 formed integral with the outsole plate 16, and integral spikes or cleats 58. The integral spikes 58 may consist of the customary single spike, the new green-friendly spike, or any other type of spike or cleat. The integral spikes replace the traditional detachable spikes. Thus, this shoe outsole embodiment is useful for sports, including, but not limited to golf, where pivot control is desirable and detachable spikes or cleats are neither necessary nor desirable.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. A sole for footwear comprising:

an outsole defining a forefoot portion, a rearfoot portion, and a periphery, a plurality of first traction projections extending out from the outsole, a forefoot group of the plurality of first traction projections being arranged in a plurality of elliptical configurations around a first pivot point located in the forefoot portion, and a rearfoot group of the plurality of first traction projections being arranged in a plurality of elliptical configurations around a second pivot point located in the rearfoot portion of the outsole, the plurality of first traction projections defining a projection body, the projection body having a lengthwise portion, the lengthwise portion of the projection body orientated in the general direction of the first and second pivot points, a plurality of ribs connected to the plurality of first traction projections, a plurality of second traction projections extending out from the outsole, the plurality of second traction projections being located along the periphery of the outsole.

2. The sole as in claim 1 wherein the elliptical arrangements of first traction projections are concentrically positioned about the first and second pivot points.

3. The sole as in claim 1 wherein the plurality of elliptically configured first traction projections further comprise detachable traction elements received in openings in the outsole.

4. The sole as in claim 3 wherein the detachable traction elements are cleats.

5. The sole as in claim 3 wherein at least some of the plurality of first traction projections are located between the openings in the outsole.

* * * * *